US007288159B2

(12) United States Patent
Cordova

(10) Patent No.: US 7,288,159 B2
(45) **Date of Patent: *Oct. 30, 2007**

(54) HIGH IMPACT AND WEAR RESISTANT STEEL

(75) Inventor: J. Vincent Cordova, Pueblo, CO (US)

(73) Assignee: CF&I Steel, L.P., Pueblo, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/120,471

(22) Filed: Apr. 10, 2002

(65) Prior Publication Data

US 2003/0192625 A1 Oct. 16, 2003

(51) Int. Cl.
*C21D 9/06* (2006.01)

(52) U.S. Cl. ..... 148/584; 148/320; 148/581

(58) Field of Classification Search ..... 148/320, 148/581, 584

See application file for complete search history.

(56) References Cited

U.S. PATENT DOCUMENTS

| | | | |
|---|---|---|---|
| 4,913,747 | A | 4/1990 | Fukuda et al. |
| 5,658,400 | A | 8/1997 | Uchino et al. |
| 5,759,299 | A | 6/1998 | Yokoyama et al. |
| 5,762,723 | A | 6/1998 | Ueda et al. |
| 5,830,286 | A | 11/1998 | Veda et al. |

FOREIGN PATENT DOCUMENTS

| | | | |
|---|---|---|---|
| JP | 401159327 | * | 6/1989 |
| JP | 2000-178690 | * | 6/2000 |
| JP | 2001-3140 | * | 1/2001 |

OTHER PUBLICATIONS

English translation of Japanese patent 1-159327, Hideaki Kageyama, et al, Jun. 22, 1989.*

* cited by examiner

*Primary Examiner*—Scott Kastler
(74) *Attorney, Agent, or Firm*—Schwabe Williamson & Wyatt

(57) ABSTRACT

An improved steel railroad rail, and methods for producing same, having a high-carbon content in a range from more than 0.9 to 1.1 wt % is provided that has increased wear resistance and increased fracture toughness over conventional steel rail. The high-carbon rail is characterized as having a pearlitic phase of an eutectoid nature. The average ultimate tensile strength is in a range from 204,860 to 222,120 psi, with a minimum of 174,000 psi. The average yield strength is in a range from 132,320 to 148,450 psi, with the minimum of 120,000 psi. The average percent elongation is in a range from 10.50 to 11.14, with a minimum of 10.00. The Brinell hardness on the surface at any position of the head top and upper gage corners of the rail is in a range from 390 to 440 BHN. The hardness 19 mm below the top surface is in a range from 360 to 435 BHN and 19 mm below the surface at the upper gage corners is in a range from 360 to 410 BHN. The characteristics of the steel rail produced in accordance with the present invention is a substantial improvement as compared with rail used today. The production of a fully pearlitic steel rail having a carbon content from more than 0.9 to 1.1 wt % is remarkable and unexpected. A steel rail of this type having a hardness in a range from 400 to 440 BHN and a combination of yield strength, ultimate tensile strength, elongation and surface and in-depth Brinell hardness goes beyond all expectations and results in a superior and commercially important steal rail.

6 Claims, 1 Drawing Sheet

HIGH IMPACT AND WEAR RESISTANT STEEL

FIELD OF THE INVENTION

This invention pertains to steel compositions and methods of producing steel railroad rail, and particularly, but not by way of limitation, to steel rail resistant to damage due to impact and wear.

BACKGROUND OF INVENTION

Efficient railroad transportation systems require that railroad rails withstand the demands of high-axle loads, acceleration and deceleration friction and stress, and high usage. Rail comprises a head, a base, and a web between the head and base. The head comprises an upper gage corner on each side of the top of the head. Rolling fatigue and damage occurs on the top surface of the head of straight rail and typically one of the two upper gage corners of curved rail and is a constant maintenance issue requiring periodic rail replacement.

Fracture toughness, or toughness, is a term used in the art to describe steel's resistance to cracking. Steel having a high toughness while maintaining ductility is less prone to fatigue cracking. The steel will be more fracture resistant to impact loads but more prone to wear and abrasion under sliding loads. Hardness is a term used in the art to describe steel's resistance to deformation. A steel having a high hardness while retaining ductility is less prone to wear and abrasion. Ideal steel for rail would be one that has a high toughness and a high hardness.

In its simplest form, steel is composed of a mixture of iron (Fe) and carbon (C). During the production process, the mixture is cooled from about 1000.degree.C. to 723.degree.C. For a mixture of iron and carbon with a 0.83 wt % of C, at 723.degree.C., the iron and carbon transforms into a solid solution of alternating lamellae of soft iron, known as ferrite, and very hard iron carbide, known as cementite. The resulting steel has an all pearlite structure and is referred to as eutectoid. Eutectoid steel is characterized as having the highest tensile strength as compared with other iron-carbon ratios.

An iron and carbon mixture having less than 0.83 wt % of C results in pearlitic steel that is hypo-eutectoid. That is, when the iron and carbon mixture is cooled from about 1000.degree.C. to 723.degree.C., some of the mixture transforms into ferrite. At 723.degree.C., the remaining iron and carbon transforms into a solid solution of pearlite. If the steel is cooled very slowly, the first to transform ferrite will diffuse into the ferrite layers of the pearlite. Common steel producing techniques compromise the cooling time for efficiencies and through-put of the mill, resulting in a cooling process that is too fast for complete diffusion. Hypo-eutectoid pearlitic steel approaching 0.83 wt % of C is characterized as having good resistance to wear because of the hard cementite in the pearlite and some degree of toughness as a result of the ferrite's ability to flow in an elastic/plastic manner.

Iron and carbon mixtures having a decreasing amount of wt % of C below 0.83 wt % will produce a steel having an increasing amount of ferrite, as more ferrite will form before the mixture transforms into pearlite. This will produce steel of increasing toughness and decreasing hardness.

Iron and carbon mixtures having more than 0.83 wt % of C are referred to as hyper-eutectoid. That is, when the iron and carbon mixture is cooled from about 1000.degree.C. to 723.degree.C., some of the mixture transforms into cementite. At 723.degree.C., the remaining iron and carbon transforms into pearlite. Therefore, hyper-eutectoid steel comprises pearlite and cementite.

Steel compositions having an increasing amount of wt % of C above 0.83 wt % will produce a steel having an increasing amount of cementite, as more cementite will form before the remaining iron and carbon transforms into pearlite. This will produce steel of increasing hardness and decreasing toughness. Hyper-eutectoid pearlitic steel is characterized as being very hard and therefore wear resistant, but brittle.

Railroad rail would benefit from being made from steel having both high toughness and high hardness. From the forgoing discussion, one can understand that these properties are mutually exclusive. Increasing amounts of carbon along with alloying agents and manufacturing processing parameters are used in an attempt to retain the toughness of a hypo-eutectoid steel yet increase the hardness. Alloying can be used to produce a finer structure pearlite that will increase hardness as well as suppress the formation of cementite. The speed in which the steel is cooled from a high roll-forming temperature through the eutectoid temperature, 723.degree.C., and finally to ambient temperature has a dramatic effect on the formation of the pearlitic structure. To date, steel rails approaching a 0.9 wt % of C while retaining a hypo-eutectoid structure have been achieved resulting in a rail of increased hardness. The goal of producing a pearlitic steel rail having a carbon content greater than 0.9 wt % has, until now, not been achieved and was considered by those practicing in the field to be unobtainable.

The present invention provides a pearlitic eutectoid steel rail having greater than 0.9 wt % of C to as much as 1.1 wt % of C.

SUMMARY OF INVENTION

An improved high-carbon steel railroad rail having a range from more than 0.9 to 1.1 wt % C is provided that has increased wear resistance and increased fracture toughness over conventional steel rail. The high-carbon rail is characterized as having a pearlitic phase of an eutectoid nature. The average ultimate tensile strength is in a range from 204,860 to 222,120 psi, with a minimum of 174,000 psi. The average yield strength is in a range from 132,320 to 148,450 psi, with the minimum of 120,000 psi. The average percent elongation is in a range from 10.50 to 11.14, with a minimum of 10.00. The Brinell hardness (BHN) on the surface at any position of the head top and upper gage corners of the rail is in a range from 390 to 440 BHN. The hardness 19 mm below the top surface is in a range from 360 to 435 BHN, and the hardness 19 mm below the surface of the upper gage corners is in a range from 360 to 410 BHN.

The production of a fully pearlitic steel rail having a carbon content from more than 0.9 to 1.1 wt % is remarkable and unexpected. A steel rail of this type having a hardness in a range from 400 to 440 BHN goes beyond all expectations and results in a superior and commercially important steel rail.

A first embodiment of the present invention is a high-carbon steel rail with increased wear resistance and increased fracture toughness comprising the elements in a range from more than 0.9 to 1.1 wt % of C, 0.26 to 0.80 by wt % of Si, 0.8 to 1.2 wt % of Mn, less than or equal to 0.35 wt % of Cr, the balance of iron and residual elements, a pearlitic phase of eutectoid structure, with an average ultimate tensile strength in a range from 204,860 to 222,120 psi, with a minimum of 174,000 psi, an average yield strength in a range from 132,320 to 148,450 psi, with the minimum of 120,000 psi, and an average percent elongation in a range from 10.50 to 11.14, with a minimum of 10.00.

A second embodiment of the present invention is a high-carbon steel rail with increased wear resistance and increased fracture toughness comprising the elements in a range from more than 0.9 to 1.1 wt % of C, 0.26 to 0.80 by wt % of Si, 0.8 to 1.2 wt % of Mn, less than or equal to 0.35 wt % of Cr, and a maximum of each of 0.45 wt % of Cu, 0.25 wt % of Ni, 0.05 wt % of Mo, 0.025 wt % of S, 0.01 wt % of Al and 0.037 wt % of P, the balance of iron and residual elements, a pearlitic phase of eutectoid structure, with an average ultimate tensile strength in a range from 204,860 to 222,120 psi, with a minimum of 174,000 psi, an average yield strength in a range from 132,320 to 148,450 psi, with the minimum of 120,000 psi, and an average percent elongation in the range from 10.50 to 11.14, with a minimum of 10.00.

A third embodiment of the present invention is a high-carbon steel rail with increased wear resistance and increased fracture toughness comprising the elements in a range from more than 0.9 to 1.1 wt % of C, 0.26 to 0.80 by wt % of Si, 0.8 to 1.2 wt % of Mn, less than or equal to 0.35 wt % of Cr, 0.005 to 0.105 wt % of Ti, 0.00 to 0.020 wt % of V and a maximum of each of 0.45 wt % of Cu, 0.25 wt % of Ni, 0.05 wt % of Mo, 0.025 wt % of S, 0.01 wt % of Al and 0.037 wt % of P, the balance of iron and residual elements, a pearlitic phase of eutectoid structure, with an average ultimate tensile strength in a range from 204,860 to 222,120 psi, with a minimum of 174,000 psi, an average yield strength in a range from 132,320 to 148,450 psi, with the minimum of 120,000 psi, and an average percent elongation in a range from 10.50 to 11.14, with a minimum of 10.00.

A fourth embodiment of the present invention is a high-carbon steel rail with increased wear resistance and increased fracture toughness comprising the elements 1.01 wt % of C, 0.52 by wt % of Si, 1.05 wt % of Mn, 0.24 wt % of Cr, 0.35 wt % of Cu, 0.20 wt % of Ni, 0.005 wt % of Mo, 0.020 wt % of S, and 0.010 wt % of Al, 0.025 wt % of Ti, 0.010 wt % of V, 0.020 wt % of P, the balance of iron and residual elements, a pearlitic phase of eutectoid structure, with an average ultimate tensile strength in a range from 204,860 to 222,120 psi, with a minimum of 174,000 psi, an average yield strength in a range from 132,320 to 148,450 psi, with the minimum of 120,000 psi, and an average percent elongation in a range from 10.50 to 11.14, with a minimum of 10.00.

A fifth embodiment of the present invention is a high-carbon steel rail with increased wear resistance and increased fracture toughness comprising the elements 0.95 wt % of C, 0.47 by wt % of Si, 0.95 wt % of Mn, 0.20 wt % of Cr, 0.25 wt % of Cu, 0.15 wt % of Ni, 0.002 wt % of Mo, 0.010 wt % of S, and 0.005 wt % of Al, 0.018 wt % of Ti, 0.001 wt % of V, 0.010 wt % of P, the balance of iron and residual elements, a pearlitic phase of eutectoid structure, with an average ultimate tensile strength in a range from 204,860 to 222,120 psi, with a minimum of 174,000 psi, an average yield strength in a range from 132,320 to 148,450 psi, with the minimum of 120,000 psi, and an average percent elongation in a range from 10.50 to 11.14, with a minimum of 10.00.

A sixth embodiment of the present invention is a high-carbon steel rail with increased wear resistance and increased fracture toughness comprising the elements 0.99 wt % of C, 0.50 by wt % of Si, 0.97 wt % of Mn, 0.22 wt % of Cr, 0.30 wt % of Cu, 0.11 wt % of Ni, 0.003 wt % of Mo, 0.015 wt % of S, and 0.001 wt % of Al, 0.014 wt % of Ti, 0.005 wt % of V, 0.015 wt % of P, the balance of iron and residual elements, a pearlitic phase of eutectoid structure, with an average ultimate tensile strength in a range from 204,860 to 222,120 psi, with a minimum of 174,000 psi, an average yield strength in a range from 132,320 to 148,450 psi, with the minimum of 120,000 psi, and an average percent elongation in a range from 10.50 to 11.14, with minimum of 10.00.

A seventh embodiment of the present invention is a high-carbon steel rail with increased wear resistance and increased fracture toughness comprising the elements 0.97 wt % of C, 0.49 by wt % of Si, 1.00 wt % of Mn, 0.23 wt % of Cr, 0.43 wt % of Cu, 0.17 wt % of Ni, 0.004 wt % of Mo, 0.018 wt % of S, and 0.003 wt % of Al, 0.022 wt % of Ti, 0.013 wt % of V, 0.013 wt % of P, the balance of iron and residual elements, a pearlitic phase of eutectoid structure, with an average ultimate tensile strength in a range from 204,860 to 222,120 psi, with a minimum of 174,000 psi, an average yield strength in a range from 132,320 to 148,450 psi, with the minimum of 120,000 psi, and an average percent elongation in a range from 10.50 to 11.14, with a minimum of 10.00.

An eighth embodiment of the present invention is a high-carbon steel rail with increased wear resistance and increased fracture toughness comprising the elements 0.96 wt % of C, 0.48 by wt % of Si, 0.99 wt % of Mn, 0.24 wt % of Cr, 0.40 wt % of Cu, 0.13 wt % of Ni, 0.002 wt % of Mo, 0.012 wt % of S, and 0.000 wt % of Al, 0.016 wt % of Ti, 0.008 wt % of V, 0.017 wt % of P, the balance of iron and residual elements, a pearlitic phase of eutectoid structure, with an average ultimate tensile strength in a range from 204,860 to 222,120 psi, with a minimum of 174,000 psi, an average yield strength in a range from 132,320 to 148,450 psi, with the minimum of 120,000 psi, and an average percent elongation in a range from 10.50 to 11.14, with minimum of 10.00.

A ninth embodiment of the present invention is a high-carbon steel rail with increased wear resistance and increased fracture toughness comprising the elements 1.00 wt % of C, 0.47 by wt % of si, 0.95 wt % of Mn, 0.20 wt % of Cr, 0.33 wt % of Cu, 0.11 wt % of Ni, 0.003 wt % of Mo, 0.015 wt % of S, and 0.005 wt % of Al, 0.018 wt % of Ti, 0.002 wt % of V, 0.010 wt % of P, the balance of iron and residual elements, a pearlitic phase of eutectoid structure, with an average ultimate tensile strength in a range from 204,860 to 222,120 psi, with a minimum of 174,000 psi, an average yield strength in a range from 132,320 to 148,450 psi, with the minimum of 120,000 psi, and an average percent elongation in a range from 10.50 to 11.14, with minimum of 10.00.

A tenth embodiment of the present invention is a process for producing high-carbon steel rail with increased wear resistance and increased fracture toughness comprising forging a steel billet having the same chemical composition as defined in the first embodiment, hot rolling the steel to have a rolling finishing temperature in a range from 800.degree.C. to 1000.degree.C. thereby forming a rail, and cooling the rail at a cooling rate in a range from 3.3.degree.C./sec to 4.3.degree.C./sec. between a pearlite transformation-starting temperature or more and 480.degree.C. or less.

An eleventh embodiment of the present invention is a process for producing high-carbon steel rail with increased wear resistance and increased fracture toughness comprising forging a steel billet having the same chemical composition as defined in the first embodiment, hot rolling the steel to have a rolling finishing temperature in a range from 800.degree.C. to 1000.degree.C. thereby forming a rail, and cooling the rail at a cooling rate in a range from 3.3.degree.C./sec to 4.3.degree.C./sec. between a pearlite transformation-starting temperature or more and 480.degree.C. or less utilizing a line slack quench (LSQ) apparatus which uses air at a given pressure in an air-quench operation.

DESCRIPTION

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

Figure 1:
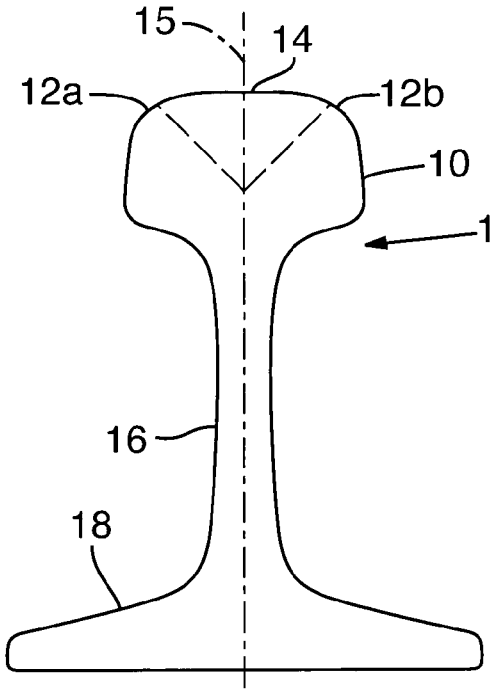
FIG. 1 illustrates a cross-section of a common type of railroad rail.

FIG. 1 illustrates a cross-section of a common type of railroad rail 1. The rail 1 comprises a head 10, a base 18 , and a web 16 between the head 10 and the base 18. The head 10 comprises a top surface 14 and a left and right upper gage corner 12*a*, 12*b*. The train wheel (not shown) contacts the rail 1 about the head 10.

The present invention is a product of intense research and experimentation to formulate a steel rail 1 having greater than 0.85 wt % carbon content while retaining substantially eutectoid physical characteristics in at least the rail head 10; heretofore unachieved in the history of manufacturing steel rail. It has been found that the combination of a steel with specific alloying agents, thermo-mechanical rolling and heat treatment methods produce a rail 1 with eutectoid physical characteristics with as much as 1.10 wt % of C. The resulting rail 1 exhibits superior hardness to resist abrasion while retaining desirable toughness to resist impact and fatigue damage. The characteristics of the steel rail 1 produced in accordance with the present invention is a substantial improvement as compared with rail used today. The rail 1 exhibits a combination of yield strength, ultimate tensile strength, elongation and surface and in-depth Brinell hardness in a combination much more desirable than anticipated or expected.

In accordance with an embodiment of the invention, there is provided a high-carbon steel railroad rail 1 having a high resistance to abrasion and rolling fatigue damage, the rail 1 comprising the elements in a range from more than 0.9 to 1.1 wt % of C, 0.26 to 0.80 by wt % of Si, 0.8 to 1.2 wt % of Mn, and less than or equal to 0.30 wt % of Cr, and a maximum of each of 0.45 wt % of Cu, 0.25 wt % of Ni, 0.05 wt % of Mo, 0.025 wt % of S, 0.01 wt % of Al and 0.037 wt % of P, the balance of iron and residual elements. The head 10 of the rail 1 of the present embodiment has a substantially uniform fine pearlite structure; the entire rail 1 containing no free ferrite. The pearlite structure with substantially eutectoid properties is produced using a specified cooling process explained below.

In another embodiment of the invention, the rail 1 of the above composition further comprises at least one element selected from the group consisting of a range from 0.005 to 0.105 wt % of Ti and 0.00 to 0.020 wt % of V, further increasing the rail's 1 wear resistance.

The range of chemical components for steel rail 1 according to the present invention, is provided for the following reasons:

C: 0.9-1.1 wt %

Carbon, as explained above, contributes to the hardness of the steel. The amount of carbon directly determines if the steel will have hypo-eutectoid properties (i.e., pearlite with ferrite), eutectoid properties (i.e., pearlite only), or hyper-eutectoid properties (i.e., pearlite with cementite). The larger the amount of carbon, the harder the steel, but the challenge is to prevent the steel from going hyper-eutectoid. Too little carbon results in steel rail 1 that is not abrasion resistant; too much carbon results in steel rail 1 that is brittle. The present invention provides steel compositions for rail 1 applications that are eutectoid up to 1.1 wt % C.

Si: 0.26-0.8 wt %

Silicon is used to deoxidize the steel matrix that improves the strength of the resulting steel. An amount of silicon approaching 1.0 wt % is predicted to increase the brittleness of the resulting steel. The range of silicon that has been determined to be effective in accordance with this invention has a lower limit of about 0.26 wt % and an upper limit of about 0.80 wt %.

Mn: 0.8-1.2 wt %

Manganese, like silicon is also used to deoxidize the steel matrix. Further, manganese improves the steel's hardness. As the amount of manganese is increased, the manganese will segregate from the matrix, which is detrimental to the resulting steel's toughness. The range of manganese that has been determined to be effective in accordance with this invention has a lower limit of about 0.8 wt % and an upper limit of about 1.2 wt %.

Cr: less than or equal to about 0.35 wt %

Chromium improves the strength of the resulting steel by my making the lamellae of the pearlite thinner. Chromium has an upper limit; in excess, chromium will promote the growth of cementite. It has been determined that as much as 0.35 wt % of Cr is acceptable for the steel of this invention, and therefore, is used as an upper limit.

Cu: less than about 0.45 wt %

A quantity of 0.45 wt % of Cu or less is acceptable for the steel of this invention, and therefore, is used as an upper limit.

S: less than about 0.025 wt %

Sulfur is an inevitable impurity that is detrimental to the toughness of the resulting steel. It has been determined that as much as 0.025 wt % of S is acceptable for the steel of this invention, and therefore, is used as an upper limit.

Al: 0.01 wt %

It has been determined that as much as 0.01 wt % of Al is acceptable for the steel of this invention, and therefore, is used as an upper limit.

P: less than about 0.025 wt %

Phosphorus is an inevitable impurity that is detrimental to the toughness of the resulting steel. It has been determined that as much as 0.025 wt % of P is acceptable for the steel of this invention, and therefore, is used as an upper limit.

Improving Agents

Mo: less than about 0.050 wt %

Molybdenum in a quantity up to 0.050 wt % is utilized for its hardenability characteristics of the resulting alloy.

Ti: 0.005-0.105 wt %

Titanium is used to control austenitic grain growth in the hot rolling process. This provides a finer grain in the final product. It has been determined that a range of 0.005-0.105 wt % is acceptable for improving the steel of this invention.

V: up to 0.020 wt %

Vanadium improves the hardness and strength of the resulting steel. In excess, vanadium will form cementite resulting in the steel becoming brittle. It has been determined that an upper limit of 0.020 wt % is acceptable for improving the steel of this invention.

A billet of each of the chemical compositions shown in Table 1 below was produced. Each billet was hot rolled into rail 1 such that the finishing temperature was in a range from 800.degree.C. to 1000.degree.C. The rail 1 tested was a "section 141" configuration and had an overall width and height of 152 mm and 189 mm, respectively, with a corresponding head 10 width and height of 78 mm and 55 mm, respectively. The hot-rolling was followed by forced air cooling at a rate of about 4.degree.C./sec (a range from 3.3.degree.C./sec to 4.3.degree.C./sec.) until the rail 1 reached a temperature of 400.degree.C. Samples of each rail 1 were tested for mechanical and metallographic analysis, including hardness at various locations and depths below the surface, yield strength and tensile strength.

Table 2 presents the mechanical properties of the samples of Table 1.The resulting high carbon steel rail 1 according to this embodiment, for an average composition comprising the elements 1.0 wt % of C, 0.95 wt % of Mn, 0.45 wt % of Si and 0.25 wt % of Cr, metallographic analysis revealed little or no free cementite or ferrite. Essentially, the resulting steel was eutectoid, that is, all pearlite. The ultimate tensile strength was in a range from 205,000 to 222,000 psi. The yield strength was in a range from 135,000 to 148,000 psi. The percent elongation was in a range from 10.50 to 11.10.

The resulting high carbon steel rail 1 according to this embodiment has a Brinell hardness (BHN) on any position of the head 10 top surface 14 and the surface of the left and right upper gage corners 12*a*, 12*b* of the rail 1 in a range from 396 to 432 BHN, and specifically at the centerline 15 of the top surface 14 in a range from 420 to 432 BHN and at the surface of the left and right upper gage corners 12*a*, 12*b* in a range from 419 to 430 BHN. The hardness 19 mm below the top surface 14 at the centerline 15 is in a range from 397 to 408 BHN at. The hardness 19 mm below the surface of the left and right upper gage corners 12*a*, 12*b* is in a range from 396 to 409 BHN.

TABLE 1

| | Chemical compositions (wt %) with remainder substantially Fe | | | | | | | | | | | |
|---|---|---|---|---|---|---|---|---|---|---|---|---|
| No. | C | Mn | P | S | Si | Cu | Ni | Cr | Mo | Al | V | Ti |
| 1 | 1.01 | 1.05 | 0.020 | 0.020 | 0.52 | 0.35 | 0.20 | 0.24 | 0.005 | 0.010 | 0.010 | 0.015 |
| 2 | 0.95 | 0.95 | 0.010 | 0.010 | 0.47 | 0.25 | 0.15 | 0.20 | 0.002 | 0.005 | 0.001 | 0.018 |
| 3 | 0.99 | 0.97 | 0.015 | 0.015 | 0.50 | 0.30 | 0.11 | 0.22 | 0.003 | 0.001 | 0.005 | 0.014 |
| 4 | 0.97 | 1.00 | 0.013 | 0.018 | 0.49 | 0.43 | 0.17 | 0.23 | 0.004 | 0.003 | 0.002 | 0.017 |
| 5 | 0.96 | 0.99 | 0.017 | 0.012 | 0.48 | 0.40 | 0.13 | 0.24 | 0.002 | 0.000 | 0.008 | 0.016 |
| 6 | 1.00 | 0.95 | 0.010 | 0.015 | 0.47 | 0.33 | 0.11 | 0.20 | 0.003 | 0.005 | 0.002 | 0.018 |

Comparing these physical properties with conventional steel rails 1 will emphasize the benefits of the steel rails 1 of this embodiment. Conventional rail 1 has a hardness in a range from 300 to 320 BHN compared with the steel of this embodiment with a range from 390 to 440 BHN. Conventional rail 1 has a tensile strength in a range from 145,000 to 160,000 psi compared with the steel of this embodiment with a range from 174,000 to 222,000 psi. Conventional rail 1 has a yield strength in a range from 74,000 to 90,000 psi compared with the steel of this embodiment with a range from 120,000 to 148,450 psi.

TABLE 2

| | Steel Rail Physical Properties | | | | | | |
|---|---|---|---|---|---|---|---|
| | Brinell Hardness | | | | Yield | Ultimate | |
| Sample | Centerline Surface | Centerline @ 19 mm | Gage Corner surface | Gage Corner @ 19 mm | Strength (psi) | Tensile Strength (psi) | % Elongation |
| 1 | 422 | 404 | 421 | 409 | 135,000 | 205,000 | 10.50 |
| 2 | 425 | 400 | 420 | 402 | 137,500 | 210,000 | 10.70 |
| 3 | 420 | 408 | 423 | 405 | 140,500 | 212,000 | 11.10 |
| 4 | 421 | 400 | 419 | 396 | 143,000 | 215,000 | 11.00 |
| 5 | 430 | 401 | 422 | 396 | 145,000 | 220,000 | 10.90 |
| 6 | 432 | 397 | 430 | 400 | 148,000 | 222,000 | 10.85 |

Figure 2:
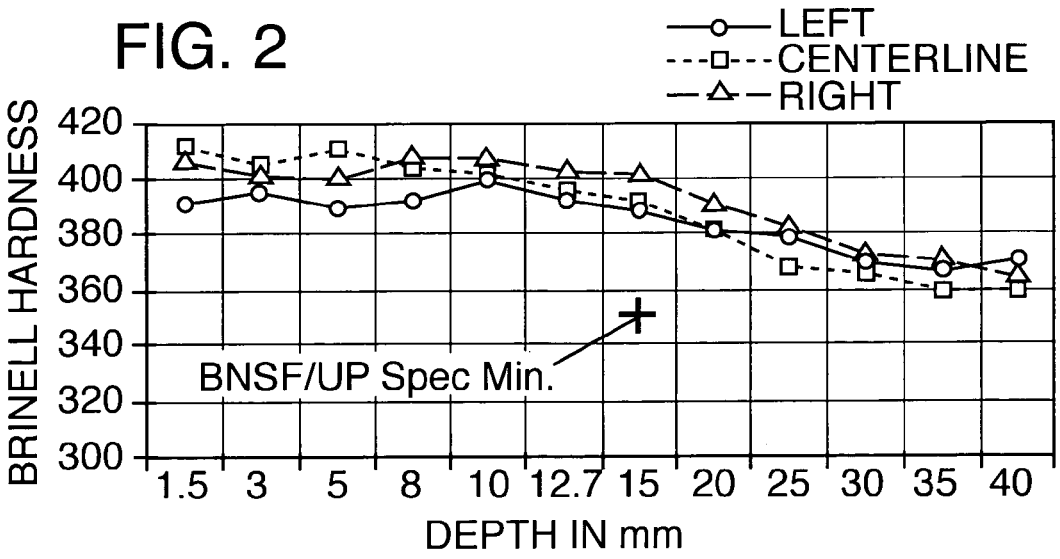
FIG. 2 presents a graph of hardness data for steel in accordance with an embodiment of the invention.

FIG. 2 shows a graphical representation of hardness data at various depths along the left upper gage corner 12*a*, the centerline 15 of the top surface 14, and the right upper gage corner 12*b* of another sample of the high carbon steel rail 1 according to this embodiment. The data is compared with the Burlington Northern Santa Fe/Union Pacific (BNSF/UP) specified minimum of 350 BHN at 15 mm below the surface 14. The Brinell hardness remains substantially uniform across the surface 14 of the head 10 as well as up to a depth of 15 mm with a value in a range from 385 to 412 BHN. The Brinell hardness begins to drop off at 15 mm depth to a low of 360 BHN at a 40 mm depth. The high carbon steel rail 1 according to this embodiment significantly exceeds the BNSF/UP specified minimum.

The production of a fully pearlitic steel rail having a carbon content from more than 0.9 to 1.1 wt % is remarkable and unexpected. A steel rail of this type having a hardness in a range from 400 to 440 BHN goes beyond all expectations and results in a superior and commercially important steal rail.

Production Methods

According to an embodiment of the invention, there is provided a method for manufacturing a rail 1 of high toughness and high wear resistance having a fine pearlite structure, comprising:

preparing a steel comprising the elements in a range from more than 0.9 to 1.1 wt % of C, 0.26 to 0.80 by wt % of Si, 0.8 to 1.2 wt % of Mn, less than or equal to 0.30 wt % of Cr, and a maximum of each of 0.45 wt % of Cu, 0.25 wt % of Ni, 0.05 wt % of Mo, 0.025 wt % of S, and 0.01 wt % of Al, the balance of iron and residual elements;

hot rolling the steel to have a rolling finishing temperature in a range from 800.degree.C. to 1000.degree.C., thereby forming a rail; and cooling the rail at a cooling rate in a range from 3.3.degree.C./sec to 4.3.degree.C./sec. between a pearlite transformation-starting temperature or more and 400.degree.C. or less.

In another embodiment of the invention, the rail of the above composition further comprises at least one element selected from the group consisting of the elements in a range from 0.005 to 0.105 wt % of Ti and 0.00 to 0.020 wt % of V in light of further increasing its wear resistance.

There are four predominant production methods used in the art to cool rail. They are air cooling, air/water cooling, oil submersion, and aqueous polymer submersion. Any method may be used in the present invention as long as the prescribed controlled rate of cooling is obtained.

The air/water cooling technique presents a mist of atomized water to the rail, cooling the rail in a dual process of heat of vaporization of the water and forced convection of the air. This technique is complex if a precise rate of cooling as well as a uniform cooling over the length of the rail is to be achieved.

The oil submersion technique is where the rail is submerged into a tank of oil. Precise rate of cooling is difficult to produce with this technique as the oil itself changes temperature during the process.

The aqueous polymer submersion technique is where the rail is submerged into a tank of aqueous polymer. The aqueous polymer has a high vaporization temperature effectively preventing boiling at the rail surface and producing a more uniform cooling environment. Precise cooling rates are difficult to produce as the aqueous polymer absorbs the heat from the rail.

In one embodiment in accordance with the method of manufacturing the rail 1 of this invention, controlled-rate in-line forced-air cooling is performed. In-line cooling consists of cooling the rail 1 on the rolling line immediately after it is rolled on the same line. This is as opposed to re-heating previously cooled rail 1 to the desirable temperature at a different location off of the rolling line and cooling it using the desired cooling rate. In-line cooling is preferable in terms of manufacturing efficiency.

Steel having the composition as described above is roll-formed at a temperature of 982.degree.C. (1800.degree.F.) to a net shape of the finished rail 1 , in accordance with known roll-forming techniques. The roll-formed rail 1 enters a line slack quench (LSQ) apparatus which controls the cooling rate of the rail 1 . The rail 1 is cooled at a controlled rate in a range from 3.3.degree.C./sec to 4.3.degree.C./sec. using air at a given pressure in an air-quench operation. The rail 1 is cooled at this rate until the rail 1 reaches a temperature of 480.degree.C.

A LSQ apparatus suitable for use in the manufacture of rail 1 in accordance with the present invention comprises a conveyor and an air-handling system. Rail 1 is placed individually into the air cooling position with the use of roller lines and conveyor chains. Once in a static position the rail 1 is held in place with a clamping system. Once restrained, the rail 1 is heat-treated (cooled) with air. The air-handling system comprises a series of nozzles strategically placed around the rail 1 from which air is blown under pressure. As many as 2500 nozzles are positioned around the perimeter of the rail 1 at each of a plurality of axial locations. In total, about 45,000 nozzles are used for an 80-foot long rail 1 . The air handling apparatus controls the cooling rate of the rail 1 by controlling the air pressure at the nozzles. An air pressure of about 2.3 psig has been used with success. After heat-treatment, the rail 1 is released from the clamping system and taken out of position with the use of conveyor chain and roller lines.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the spirit or scope of the present invention. This application is intended to cover any adaptations or variations of the embodiments discussed herein.

It is also understood that those in the art can appreciate that a steel of this type and physical properties would be useful for many applications, not limited to railroad rail.

What is claimed is:

1. A method for manufacturing a fully pearlitic steel rail of high toughness and high wear resistance, consisting essentially of:

forging a steel billet comprising the elements in a range from more than 0.9 to 1 .1 wt % of C, 0.26 to 0.80 by wt % of Si, 0.8 to 1.2 wt % of Mn, less than or equal to 0.35 wt % of Cr, the balance of iron and residual elements;

hot rolling the billet to a rolling finishing temperature of about 1000° C. and thereby forming a rail; and cooling the rail at a selected cooling rate in a range from 3.3° C./sec to 4.3° C./sec. beginning substantially at said rolling finishing temperature and continuing at least until pearlite transformation-completion temperature.

2. The method according to claim 1, wherein the steel comprises a maximum of each of the elements 0.45 wt % of Cu, 0.25 wt % of Ni, 0.05 wt % of Mo, 0.025 wt % of S, and 0.01 wt % of Al.

3. The method according to claim 1, wherein the steel further comprises at least one element selected from the group consisting of the elements in a range from 0.005 to 0.105 wt % of Ti and 0.0 to 0.20 wt % of V.

4. The method according to claim 1, wherein cooling the rail is performed by utilizing a line slack quench (LSQ) apparatus which uses air at a given pressure in an air-quench operation.

5. A method of manufacturing a steel rail consisting essentially of:

producing a rail form from a composition primarily of iron and minor portions of selected and residual materials and including a known carbon content within the range of more than 0.9 and not greater than 1.1%/wt, said producing of the rail form including hot rolling of the material by retaining the temperature throughout substantially above the temperature of transformation of the composition to pearlite and whereby the hot rolling finishing temperature is about 1000° C.;

immediately and without delay following completion of hot rolling said rail, applying a determined and controlled accelerated cooling rate to the formed rail;

said selected cooling rate selected from a range of cooling rates between about 3.3° C./second and about 4.3° C./per second;

and as selected, said cooling rate maintained throughout the transformation process.

6. A method consisting essentially of:

producing a rail form from a composition primarily of iron and minor portions of selected and residual materials and including a known carbon content within the range of more than 0.9 and not greater than 1.1%/wt, and further including a known titanium content within the range of 0.005 and 0.105%/wt;

said producing of the rail form including hot rolling of the composition while retaining the temperature throughout substantially above the temperature of transformation of the composition to pearlite as necessary to ensure the absence of transformation of any portion of said rail form prior to heat treat and finishing said hot rolling at a temperature of about 1000° C.; and heat treating said rail form by applying a determined and controlled cooling rate between about 3.3° C./second and about 4.3° C./second, said cooling rate applied to said rail form from said temperature substantially immediately and without delay following completion of hot rolling said rail form, and continuing said cooling rate until completion of the transformation of the complete rail form to pearlite;

said method producing a steel rail containing no ferrite and having a minimum of 174,000 psi tensile strength, a minimum of 120,000 psi yield strength, and a minimum of 10.00% elongation with a hardness at the surface of the rail top and upper gauge corners of 390-440 BHN and at 19 mm below the top surface, a hardness of 360-435 BHN and at 19 mm below the upper gauge corner surface having a hardness in a range of 360-410 BHN.

* * * * *

UNITED STATES PATENT AND TRADEMARK OFFICE

CERTIFICATE OF CORRECTION

PATENT NO. : 7,288,159 B2
APPLICATION NO. : 10/120471
DATED : October 30, 2007
INVENTOR(S) : J. Vincent Cordova It is certified that error appears in the above-identified patent and that said Letters Patent is hereby corrected as shown below:

Col. 10, Ln. 53 Claim 1. "…0.9 to 1 .1 wt%"…" should read --…0.9 to 1.1 wt%...--;

Signed and Sealed this

Tenth Day of March, 2009

John Doll

JOHN DOLL
*Acting Director of the United States Patent and Trademark Office*